US005429372A

United States Patent [19]

Spaziani et al.

[11] Patent Number: 5,429,372

[45] Date of Patent: Jul. 4, 1995

[54] PORTABLE JIG-SAW PUZZLE WORK BOARD

[76] Inventors: Laura H. Spaziani, 2664 Capitol Hill Crescent N.W., Calgary, Alberta T2M-4C3, Canada; Henrik R. Heikel, 506 S. Grand Ave., P.O. Box 1016, Leland, Mich. 49654

[21] Appl. No.: 265,739

[22] Filed: Jun. 27, 1994

[51] Int. Cl.[6] ..... A63F 9/00

[52] U.S. Cl. ..... 273/309

[58] Field of Search ..... 273/148 R, 309, 153 R; 40/152-160

[56] References Cited

U.S. PATENT DOCUMENTS

| | | | |
|---|---|---|---|
| 1,515,594 | 11/1924 | Duncan et al. | 273/309 |
| 1,763,476 | 6/1930 | Morris | 273/309 |
| 2,100,280 | 11/1937 | Goldberger | 273/309 X |
| 3,811,680 | 5/1974 | Benesch | 273/309 |
| 4,484,745 | 11/1984 | Sleeper | 273/309 X |
| 4,813,675 | 3/1989 | Greenwood | 273/309 X |
| 5,286,025 | 2/1994 | Mulyca et al. | 273/309 X |

FOREIGN PATENT DOCUMENTS

| | | | |
|---|---|---|---|
| 2055299 | 3/1981 | United Kingdom | 273/309 |
| 2237215 | 5/1991 | United Kingdom | 273/309 |

*Primary Examiner*—William E. Stoll
*Attorney, Agent, or Firm*—Merlin B. Davey

[57] ABSTRACT

This invention provides a portable jig-saw puzzle work board comprising a rectangular, four-sided open frame having a fitted bottom interior work surface and a removable fitted transparent shatter-proof window that is securely and releasably positionable relative to the work surface such that puzzle pieces are held in place on the work surface when the window is in place and the position of the work board is changed.

5 Claims, 1 Drawing Sheet

PORTABLE JIG-SAW PUZZLE WORK BOARD

BACKGROUND OF THE INVENTION

Assembling jig-saw puzzles is a popular pastime. The activity requires a relatively large table surface which will be devoted to this purpose until the puzzle has been completed which may take up to several days. Thus the table is out of commission for other purposes, an inconvenience which may discourage starting a puzzle.

DESCRIPTION OF THE PRIOR ART

A number of efforts has been made to provide movable puzzle work boards, such as, for example, LaFleur in U.S. Pat. Nos. 4,479,651 and 4,552,361 issued in 1984 and 1985; Keller, Jr. in U.S. Pat. No. 4,486,018 issued in 1984; Palma in U.S. Pat. No. 4,687,202 issued in 1987 and Silberstein in U.S. Pat. No. 4,984,798. None of these patents teach or suggest a portable puzzle work combining the desirable and necessary features of maintaining a partially completed puzzle and unused puzzle pieces intact when they must be moved or stored, yet permitting visual access to the puzzle when stored or when moving it along with ready adaptability to use on many different size tables and in many conditions.

SUMMARY OF THE INVENTION

This invention provides a portable jig-saw puzzle work board comprising a rectangular, four-sided open frame having a fitted bottom interior work surface and a removable fitted transparent shatter-proof window, said window being securely and releasably positionable relative to said work surface such that puzzle pieces are held in place on said work surface when said window is in place and said work board is moved and stored in an upright position.

This invention provides a portable puzzle board which can be placed on any table, even one smaller than the puzzle board. The puzzle assembly can now be done in several stages on the puzzle board. Assembly can be interrupted at any time by covering the partially finished puzzle and its loose pieces with a tightly fitting shatter-proof plastic window. The window allows one to see what puzzle is being assembled and how far it has progressed, and it keeps the puzzle pieces in place on the board even if the project is stored in a vertical position. By moving the puzzle board into temporary storage, the table can be used for other purposes, or the board, covered with its window, can be left on the supporting table and used as a table top.

To be useful, the puzzle board must be large enough to accommodate most puzzles (up to some 600 square inches or 20×30 inches) and have sufficient free area for moving the loose pieces around. Thus the board surface is advantageously about 850 to 1300 square inches. A larger size would make the board heavy and cumbersome to move. The board of this invention is designed without complex clamps or other locking devices for the transparent lid. The bottom is provided with small flexible to semi-rigid supporting bumpers arranged in a pattern that renders the board stable even on a small supporting table.

The preferred configuration of the product of this invention is a generally square, light, wooden frame having a cross section of about ¾ inch square. The wooden frame is stained and varnished, making it an attractive piece of furniture. The bottom consists of a standard presswood panel, such as masonite, being about ¼ inch thick with one tempered side facing the supporting table. The untempered board surface facing up is covered with a vinyl sheeting, felt, or other suitable non-slippery coating. The masonite board is advantageously attached into a ¼ inch×¼ inch groove along the inside bottom of the entire frame.

DESCRIPTION OF THE DRAWINGS

The invention is further illustrated by the accompanying drawings wherein.

DETAILED DESCRIPTION OF THE INVENTION

Figure 1:
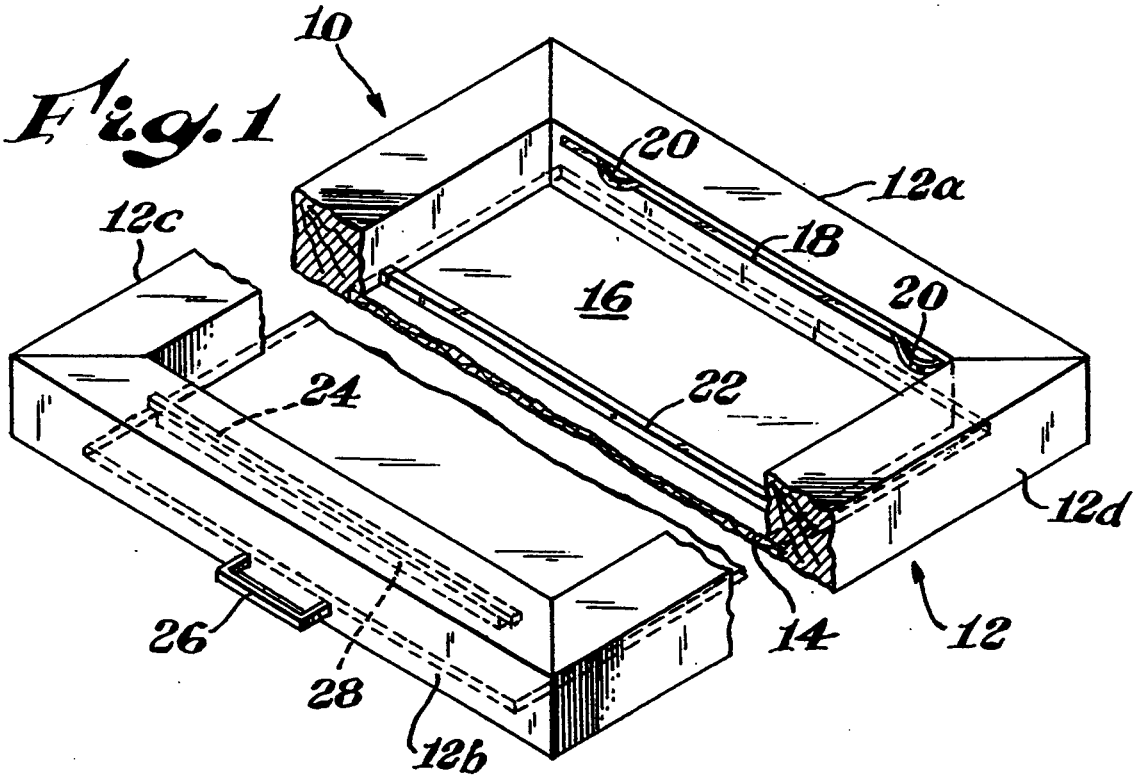
FIG. 1 is an isometric partially sectional view of a work board in accordance with one embodiment of the present invention.

Referring to the drawings, FIG. 1 is an isometric, partially sectioned view of a work board 10, having a frame 12, said frame having a bottom side **12*a*, a top side 12*b*, a left side 12*c* and a right side 12*d*, bottom work surface 14, transparent window 16, a groove 18 on the lower interior of bottom side 12*a* of the frame 12, the groove 18 optionally including springs or other compression-expansion devices 20, an optional cross-bar 22, an optional magnetic strip 24 positioned on the interior surface of top side 12*b* of frame 12 and extending between opposed sides 12*c* and 12*d* of frame 12, a handle for carrying 26 and a groove 28 in the lower interior top side 12*b* of frame 12 for engaging the top end of transparent window 16**.

Figure 2:
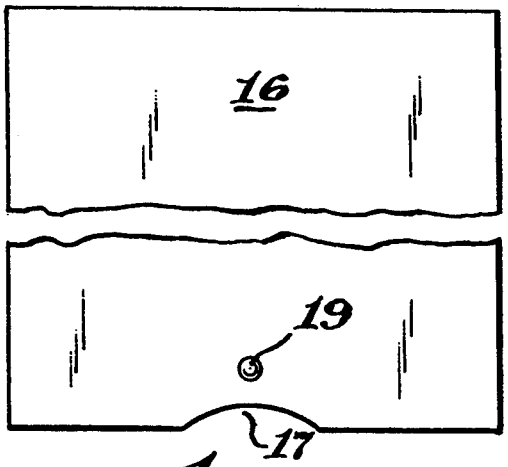
FIG. 2 is a sectioned view of an embodiment of a transparent window in accordance with the present invention.

FIG. 2 illustrates one embodiment of transparent window in accordance with the present invention. A notch 17 is cut in the top end of transparent window 16, the notch serving as a place to grasp window 16 for removal by pressing toward the springs 20 illustrated in FIG. 1. If desired, a knob of clear plastics 19, or other, material may also be affixed to the transparent window for ease of handling.

Figure 3:
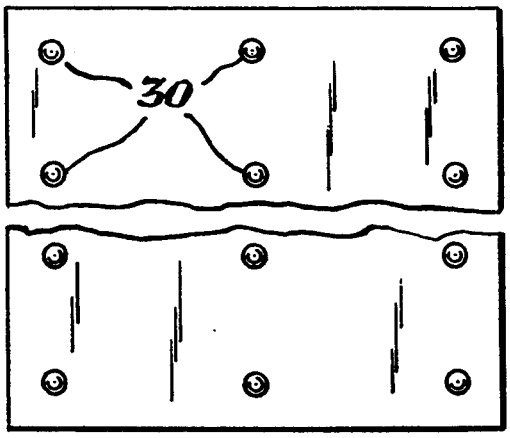
FIG. 3 is a bottom view of one embodiment of a work board in accordance with the present invention.

FIG. 3 illustrates the placement of small, semi-rigid bumpers 30 arranged in a pattern on the bottom of work board 10 such as to prevent scratching the surface upon which the work board is placed, to stabilize the work board and to prevent sagging.

Figure 4:
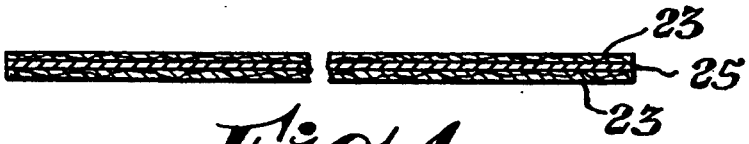
FIG. 4 illustrates a combined wood and steel bar for use in magnetically holding the transparent window in place on the work board of this invention.

In FIG. 4, a steel bar 25 is shown affixed on or embedded in a wooden strip 23. Strip 23 is employed to place over window 16 in a position juxtaposed to magnetic strip 24 and acts to assist in holding window 16 in place. Alternatively, cross-bar 22 may be used for the purpose of holding window 16 in place, as desired.

The invention is further illustrated by the following Examples:

EXAMPLE 1

The wood molding used for the frame of this Example is yellow poplar having a cross sectional dimension of ¾ inch square and cut to pieces that make the inside area of the frame 31½ inches×31½ inches (992 square inches). The frame is stained and varnished.

One side tempered ¼ inch thick masonite is cut into a 32×32 inch square. Its untempered side is covered with 32 inch wide textile vinyl wall covering having a lightly striated texture and a light tan color. An extra strength vinyl adhesive by "Allpro" (Reg. TM) is used. A thin coat of DuPont's Ludox SR (Reg. TM) colloidal silica suspension, reduced with water to 50% concentration, is applied on the front surface on the vinyl cloth. Testing with puzzle pieces, the slide angle on the untreated cloth is about 40 degrees. The slide angle increases to about 55 degrees on the dried Ludox treated surface. This anti-skid treatment helps to keep puzzle pieces in place when the board, covered with the window, is stored in a vertical position.

The bottom inside of the frame is provided with a ¼ inch×¼ inch groove into which the masonite board 14 is snugly fitted and fastened with polyvinyl acetate adhesive and small flat-head counter-sunk screws. The bottom, interior side of the frame facing the masonite has a groove—about ⅛ inch high and about ⅛–¼ inch deep, into which the edge of the bottom end of an acrylic window 16 (⅛ inch thickness) fits snugly. The acrylic sheet is cut into size 31½ inches×31⅜ inches. The side to side dimension of the acrylic lid is made about ⅛ inch narrower than the inside of the frame. The edges are ground smooth with a sander. A notch 17 of about 3 inches×½ inch is cut in the center of the window's top end. This notch serves as a point from which the window can be lifted and removed. A thin coat of "Plaskolite" (Reg. TM) antistatic agent is wiped onto the acrylic surface facing the puzzle to eliminate sticking of the puzzle pieces to the window.

The acrylic sheet 16 is kept firmly in place with a flexible magnetic strip, 31¼ inches long, ½ inch wide, and ⅛ inch thick, which is fastened with an adhesive to the interior surface of the top side (**12*b*) of the frame, and an equally long wooden rod 23 (½ inch square cross section) onto which, on one side, a 1/16 inch thick flat steel strip 25 is fastened, see FIG. 4**. As this rod is pressed against the acrylic surface, and the steel and magnetic strips face each other, the window is held in place. The rod is easily separated from the magnet.

As illustrated in FIG. 3, the tempered bottom side of the masonite 14 is provided with small self-adhering plastic bumpers 30 (such are used for numerous articles to prevent table scratching) and arranged into a pattern that makes the puzzle board even on a small table. One such bumper is placed in the center to prevent bowing of the masonite.

EXAMPLE 2

A second prototype is made with the following changes: Two steel springs fastened about 25 inches apart in a groove 18, ⅛ inch high and ¼ inch deep, cut along the entire interior of bottom side **12*a*. These springs are thin strips of stainless steel about 0.015 inches thick, about two inches long and ⅛ inch wide. The strips are bowed to a height of about ¼ inch. One end of each spring is fastened with a small nail or screw to the inside of the groove. The other end of the springs are not fastened, allowing the spring's bow to flex when the window is pushed into the groove. Because of the deeper groove, the length of the window is increased to 31¾ inches. To hold the top end of the window a groove 28, ⅛×⅛ inch, is cut in the interior surface of top side 12*b* facing groove 18**.

To handle the acrylic window, and to guide it into the grooves on the top and bottom sides, a plastic knob 19 (FIG. 2) is fastened to the window about two inches from the top end and in the center of the window. This knob enables one to slide the window into the groove in the bottom side **12*a* of frame 12 and push against the springs until the top end of the window fits inside the frame 12. While holding onto the knob the window is then slid into the groove 28, along the interior surface of side 12*b***.

EXAMPLE 3

A third prototype is made as in Example 1, but instead of using the vinyl covering for the board's surface, a green felt cloth is used which due to its texture, gives it an inherent anti-skid surface. Because of the fleecy texture of this cloth, it is exceptionally suitable for jigsaw puzzles and card and dice games as well.

EXAMPLE 4

A fourth version of the puzzle board is a slight modification of Example 1, whereby the magnetic fastener assembly is replaced with a 31 inch long wooden rod, (½ inch square cross section) onto which ends, small rubber bumpers are fastened. To keep the top end of the window 16 in place, this rod is fitted on top of the window between sides **12*c* and 12*d* of the frame along the inside of top 12*d* of the frame 12**. As this rod is snugly put in place it holds the window flat against the board.

Various modifications may be made in the present invention without departing from the spirit or scope thereof as will be apparent to those skilled in the art.

We claim:

1. A portable jig-saw puzzle work board for assembling jig-saw puzzle pieces, said work board comprising a rectangular, four-sided frame enclosing a fitted bottom interior work surface and a removable fitted transparent shatter-proof window, said window having a top end and a bottom end and a left side and a right side and said frame having a top side and a bottom side, and a left side and a right side, said top and bottom sides each having an interior surface facing each other, each of said interior surfaces defining a U-shaped groove, the groove in said bottom interior surface being deeper than said groove in said top interior surface and being adapted to engage said bottom end of said window and the groove in said top interior surface being adapted to engage said top end of said window, said window being securely and releasably positionable in said grooves without engaging either said left side or said right side of said frame, thereby holding puzzle pieces in place on said work surface when said window is in place and the position of said work board is changed from a work position to a vertical position.

2. The work board of claim 1 wherein at least one compression-expansion device is positioned in said groove in said bottom side.

3. The work board of claim 2 wherein said compression-expansion device is a spring.

4. The work board of claim 1 wherein said frame has a first side and a second side, said first and second sides being positioned between and connecting said top side and said bottom side, forming a rectangle, the interior surface of said top side comprising a magnetic strip extending between said first side and said second side, said work board further having a flat steel bar adapted to be positioned between said first side and said second side of said frame and adjacent said magnetic strip and said window, thereby holding said window to said work surface.

5. The work board of claim 1 wherein said window is held in place by a cross-bar.

* * * * *